US010995554B2

(12) United States Patent
Ren et al.

(10) Patent No.: US 10,995,554 B2
(45) Date of Patent: May 4, 2021

(54) AUTO-ADJUSTABLE DIRECTIONAL DRILLING APPARATUS AND METHOD

(71) Applicant: General Electric Company, Schenectady, NY (US)

(72) Inventors: Zhiguo Ren, Shanghai (CN); Xu Fu, Shanghai (CN); Stewart Blake Brazil, Niskayuna, NY (US); Chengbao Wang, Oklahoma City, OK (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 16/477,643

(22) PCT Filed: Jan. 12, 2018

(86) PCT No.: PCT/US2018/013530

§ 371 (c)(1),
(2) Date: Jul. 12, 2019

(87) PCT Pub. No.: WO2018/132681

PCT Pub. Date: Jul. 19, 2018

(65) Prior Publication Data

US 2019/0338596 A1 Nov. 7, 2019

(30) Foreign Application Priority Data

Jan. 12, 2017 (CN) ..... 201710023313.2

(51) Int. Cl.
*E21B 7/06* (2006.01)
*E21B 47/00* (2012.01)

(52) U.S. Cl.
CPC ..... *E21B 7/067* (2013.01); *E21B 47/00* (2013.01)

(58) Field of Classification Search
CPC ..... E21B 7/067
See application file for complete search history.

(56) References Cited

U.S. PATENT DOCUMENTS 5,307,885 A * 5/1994 Kuwana ..... E21B 7/062 175/106
6,328,119 B1 12/2001 Gillis et al.
(Continued)

FOREIGN PATENT DOCUMENTS

WO 2011049581 A1 4/2011

OTHER PUBLICATIONS

Notification of Transmittal of the International Search Report and the Written Opinion of the International Searching Authority; PCT/US2018/013530 filed Jan. 12, 2018; 9 pages.

*Primary Examiner* — D. Andrews
(74) *Attorney, Agent, or Firm* — Cantor Colburn LLP

(57) ABSTRACT

An auto-adjustable directional drilling apparatus comprises: a drive-shaft housing; a drill collar coupled to the drive-shaft housing; a drive shaft passing through the drive-shaft housing and the drill collar; an active stabilizer fixed to the drive-shaft housing and movably coupled to the drill collar; a sliding assembly comprising a base support fixed to the drill collar and a sliding base coupled to the drive-shaft housing, wherein the base support defines a slide way and the sliding base is slidably disposed in the slide way; and an actuating module coupled to the sliding base to drive the sliding base to slide along the slide way. An auto-adjustable directional drilling method is also disclosed.

13 Claims, 14 Drawing Sheets

(56) References Cited

U.S. PATENT DOCUMENTS

| | | | | |
|---|---|---|---|---|
| 2005/0236187 | A1* | 10/2005 | Chen | E21B 10/26 175/61 |
| 2009/0008151 | A1 | 1/2009 | Turner et al. | |
| 2013/0043076 | A1 | 2/2013 | Larronde et al. | |
| 2016/0060960 | A1 | 3/2016 | Parkin et al. | |

* cited by examiner

AUTO-ADJUSTABLE DIRECTIONAL DRILLING APPARATUS AND METHOD

CROSS REFERENCE TO RELATED APPLICATIONS

This is a U.S. National Stage of Application No. PCT/US2018/013530, filed on Jan. 12, 2018, which claims the benefit of Chinese Patent Application No. 201710023313.2, filed on Jan. 12, 2017, the disclosures of which are incorporated herein by reference.

BACKGROUND

This invention relates generally to an auto-adjustable directional drilling apparatus and method.

The exploration and production of hydrocarbons from subsurface reservoirs have been done for hundreds of years. Hydrocarbon recovery operations typically utilize a drill bit attached to a drill pipe to bore through an onshore or offshore subterranean rock formation until the subsurface reservoir is reached. Usually, the drill pipe is uncontrollable and only straight drilling operations are allowed, which makes it more difficult to change the drilling direction along an expected trajectory to reach the subsurface reservoir. For the directional drilling system in the art, a plurality of trip-in and trip-out operations are usually performed, and the direction of the drill pipe is manually adjusted. This kind of direction adjustment process is complex and inefficient.

Therefore, it would be desirable to provide a new and improved apparatus and method to allow a directional downhole drilling operation.

BRIEF DESCRIPTION

In one aspect, the present disclosure relates to an auto-adjustable directional drilling apparatus, comprising: a drive-shaft housing; a drill collar coupled to the drive-shaft housing; a drive shaft passing through the drive-shaft housing and the drill collar; an active stabilizer fixed to the drive-shaft housing and movably coupled to the drill collar; a sliding assembly comprising a base support fixed to the drill collar and a sliding base coupled to the drive-shaft housing, wherein the base support defines a slide way and the sliding base is slidably disposed in the slide way; and an actuating module coupled to the sliding base for driving the sliding base to slide along the slide way.

In another aspect, the present disclosure relates to an auto-adjustable directional drilling, method, comprising: generating a force via an actuating module coupled to a sliding base disposed in a slide way defined by a base support fixed to a drill collar coupled to a drive-shaft housing, an active stabilizer being fixed to the drive-shaft housing and movably coupled to the drill collar; utilizing the force to slide the sliding base along the slide way, so as to lead to a relative movement between the active stabilizer and the drill collar and generate a bent angle between the drive-shaft housing and the drill collar.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

In an effort to provide a concise description of these embodiments, not all features of an actual implementation are described in one or more specific embodiments. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of the present disclosure.

Unless defined otherwise, technical and scientific terms used herein have the same meaning as is commonly understood by one of ordinary skill in the art to which the present disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean either any, several, or all of the listed items. The use of "including", or "comprising" and variations thereof herein are meant to encompass the items listed thereafter and equivalents thereof as well as additional items. The terms "couple", "couples" or "coupled" as used herein are intended to mean either an indirect or a direct connection. Thus, if a first assembly couples to a second assembly, that connection may be through a direct connection or through an indirect mechanical or electrical connection via other assemblies and connections. The term "driven by" as used herein denotes a presence rather than a limitation. Thus, if a first object is driven by a second object, it is meant that the first object may be driven by only the second object or be driven by the second object and other objects.

Figure 1:
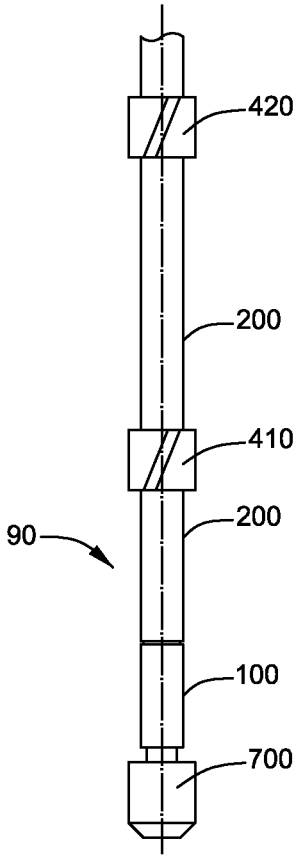
FIG. 1 is a schematic view of a BHA in accordance with an embodiment of the present invention.
Figure 2:
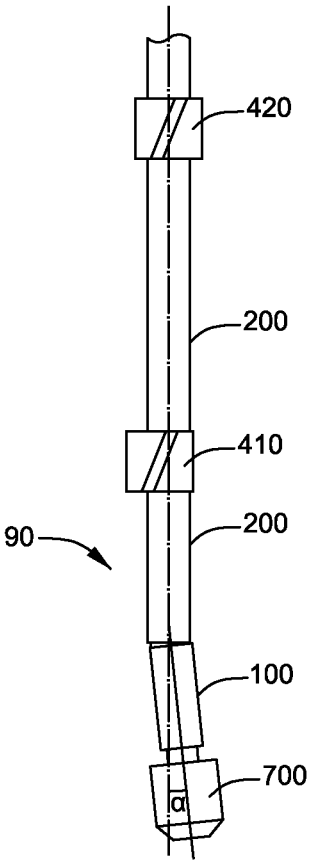
FIG. 2 is a schematic view of a BHA with a bent angle in accordance with an embodiment of the present invention.

Please refer to FIGS. 1-2. FIG. 1 illustrates a schematic view of a BHA (bottom-hole assembly) in accordance with an embodiment of the present invention. FIG. 2 illustrates a schematic view of the BHA with a bent angle in accordance with an embodiment of the present invention. The BHA may be regarded as a portion of a drill pipe.

The BHA comprises an auto-adjustable directional drilling apparatus 90 (hereinafter referred as to "auto-adjustable apparatus 90") and a stabilizer 420 coupled to the auto-adjustable apparatus 90. A drill bit 700 is coupled to the auto-adjustable apparatus 90. The auto-adjustable apparatus 90 shown in FIGS. 1-2 comprises a drive-shaft housing 100, a drill collar 200 coupled to the drive-shaft housing 100, a drive shaft 300 (as shown in FIG. 3) passing through the drive-shaft housing 100 and the drill collar 200, and an active stabilizer 410 fixed to the drive-shaft housing 100 and movably coupled to the drill collar 200.

The stabilizer 420 is fixed to the drill collar 200. The drill bit 700 is coupled to the drive shall 300. In some embodiments, a first end of the drive shaft 300 is coupled to the drill bit 700, and a second end of the drive shaft 300 is coupled to a mud motor (not shown). In some embodiments, the second end of the drive shaft 300 is coupled to the mud motor through a universal joint 310 (as shown in FIG. 3); in some embodiments, the mud motor comprises a PDM (positive displacement motor).

The active stabilizer 410 may be driven to generate a relative movement with respect to the drill collar 200. As the active stabilizer 410 is fixed to the drive-shaft housing 100, the relative movement between the active stabilizer 410 and the drill collar 200 may generate a bent angle $\alpha$ between the drive-shaft housing 100 and the drill collar 200, as shown in FIG. 2.

Figure 3:
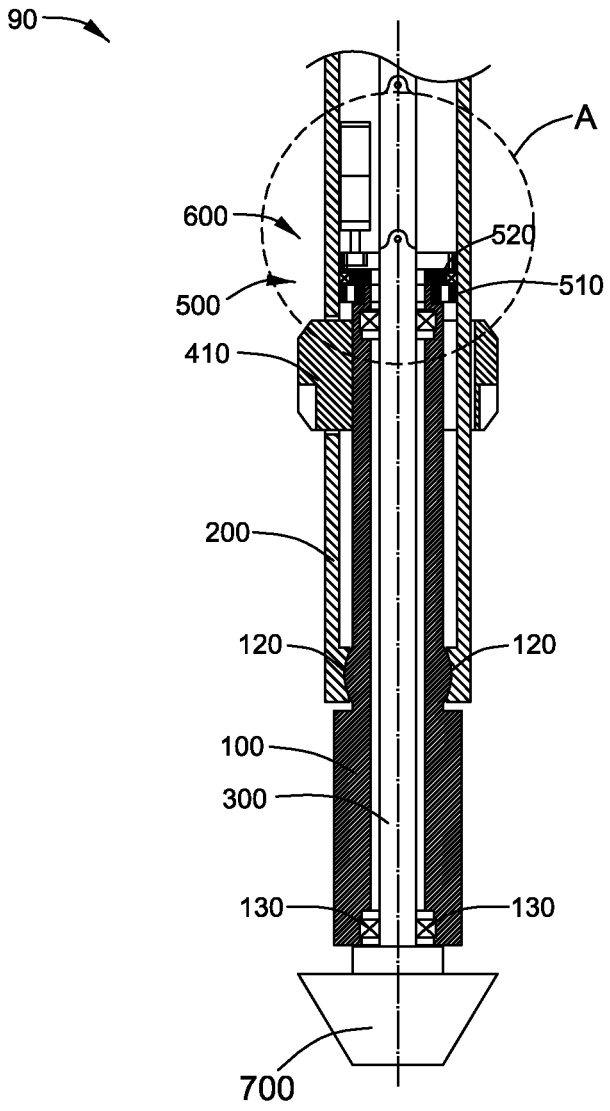
FIG. 3 is a schematic view of an auto-adjustable directional drilling apparatus in accordance with an embodiment of the present invention.

Please refer to FIG. 3. FIG. 3 illustrates a schematic view of the auto-adjustable apparatus 90 in accordance with an embodiment of the present invention.

The auto-adjustable apparatus 90 comprises a drive-shaft housing 100, a drill collar 200 coupled to the drive-shaft housing 100, a drive shaft 300 passing through the drive-shaft housing 100 and the drill collar 200, an active stabilizer 410 fixed to the drive-shaft housing 100 and movably coupled to the drill collar 200, a sliding assembly 500 coupled to the drill collar 200 and the drive-shaft housing 100, and an actuating module 600 coupled to the sliding assembly 500. In some embodiments, the drive shaft 300 is coupled to the drive-shaft housing 100 through at least one bearing assembly 130.

Figure 4:
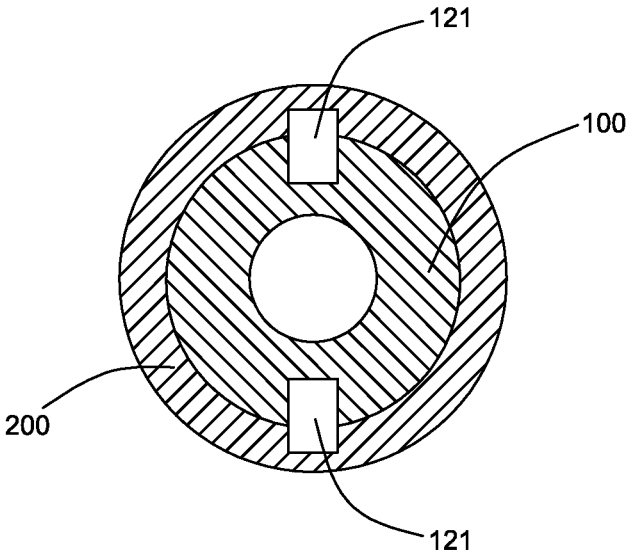
FIG. 4 is a schematic view of a drive-shaft housing coupled to a drill collar through a connection pin in accordance with an embodiment of the present invention.

Please refer to FIGS. 3-4. In some embodiments, the drive-shaft housing 100 is coupled to the drill collar 200 through a ball joint 120 and at least one connection pin 121. In some embodiments, the at least one connection pin 121 is located on the ball joint 120, and each of the at least one connection pin 121 connects the drive-shaft housing 100 and the drill collar 200.

Due to the ball joint 120 and the at least one connection pin 121, the drive-shaft housing 100 may rotate around the at least one connection pin 121. The central axis of each connection pin 121 is overlapped with the center of the ball joint 120. The drive-shaft housing 100 may rotate around the central axis of the connection pin 121.

Figure 5:
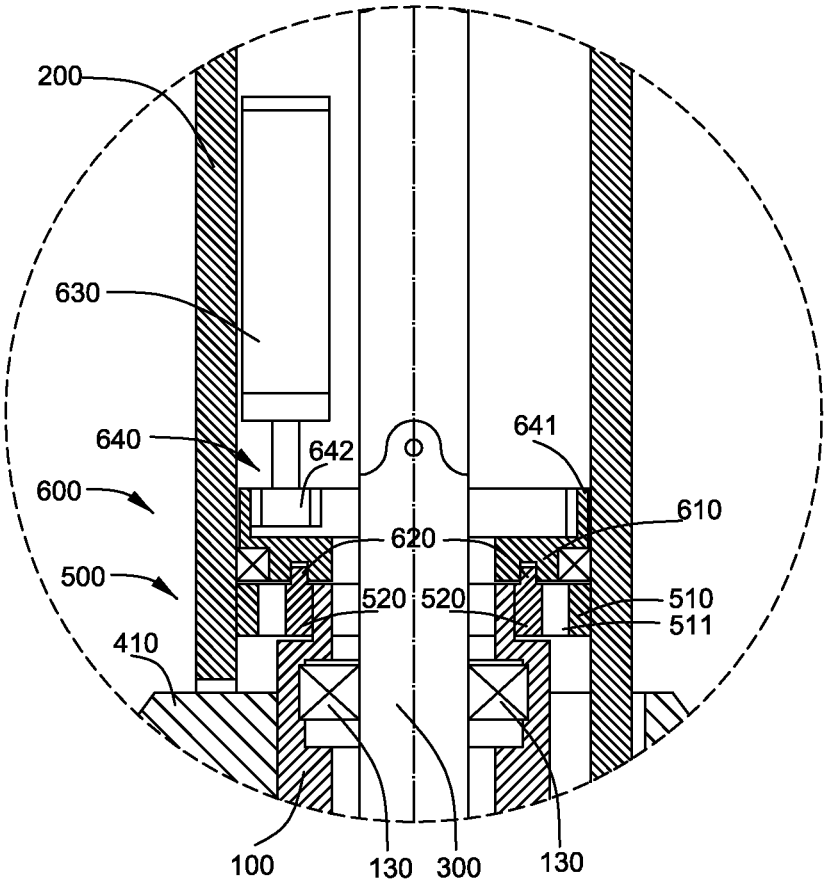
FIG. 5 is an enlarged view of the portion A shown in FIG. 3.
Figure 6:
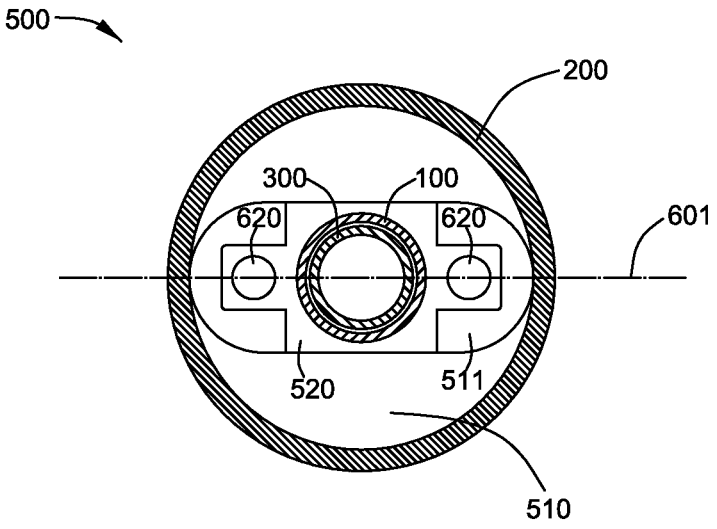
FIG. 6 is a schematic view of a sliding assembly fixed in the drill collar in accordance with an embodiment of the present invention.

Please refer to FIGS. 5-6. FIG. 5 illustrates an enlarged view of the portion A shown in FIG. 3. FIG. 6 illustrates a schematic view of the sliding assembly 500 fixed in the drill collar 200 in accordance with an embodiment of the present invention.

The sliding assembly 500 comprises a base support 510 fixed to the drill collar 200 and a sliding base 520 coupled to the drive-shaft housing 100. The base support 510 defines a slide way 511 and the sliding base 520 is slidably disposed in the slide way 511. The actuating module 600 is coupled to the sliding base 520 and drives the sliding base 520 to slide along the slide way 511. In some embodiments, the sliding base 520 is also coupled to the drive shaft 300 through the drive-shaft housing 100.

In some embodiments, the actuating module 600 comprises a cam 610, at least one pin 620 and a motor 630. The at least one pin 620 is slidably coupled to the cam 610 and fixed to the sliding base 520, and the motor 630 is coupled to the cam 610 for driving the cam 610 to rotate. In some embodiments, the at least one pin 620 may be integrated with the sliding base 520.

In some embodiments, the actuating module 600 further comprises a drivetrain 640 coupled between the motor 630 and the cam 610 to transfer a torque from the motor 630 to the cam 610. In some embodiments, the drivetrain 640 comprises a first gear 641 and a second gear 642. The first gear 641 is rotatably coupled to the drill collar 200 and fixed to the cam 610, and the second gear 642 is coupled between the motor 630 and the first gear 641. In some embodiments, the first gear 641 comprises an internal gear and the second gear 642 comprises an external gear. In some embodiments, the first gear 641 is integrated with the cam 610. In some embodiments, the drive shaft 300 passes through a center of the first gear 641.

The motor 630 drives the second gear 642 to rotate. The rotation of the second gear 642 drives the first gear 641 to rotate. As the first gear 641 is fixed to the cam 610, the rotation of the first gear 641 drives the cam 610 to rotate.

Please be noted that the drivetrain 640 in FIG. 5 is only an example and should not be understood as a limitation of the scope of the present invention. The drivetrain 640 of the present invention may comprise various changes and these changes should all be included in the scope of the present invention.

Figure 7:
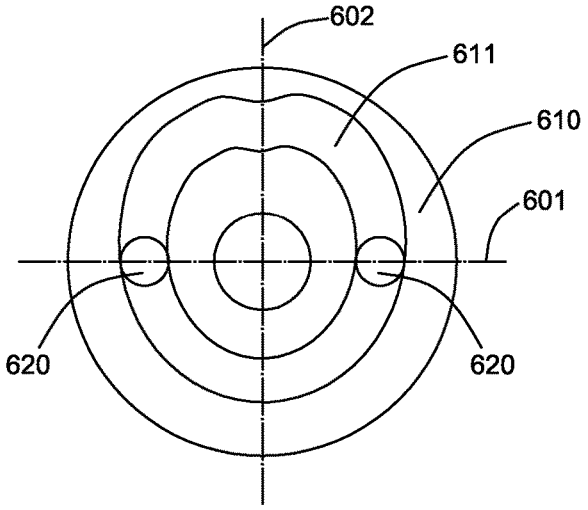
FIG. 7 is a schematic view of two pins disposed in a groove of a cam in accordance with an embodiment of the present invention.
Figure 8:
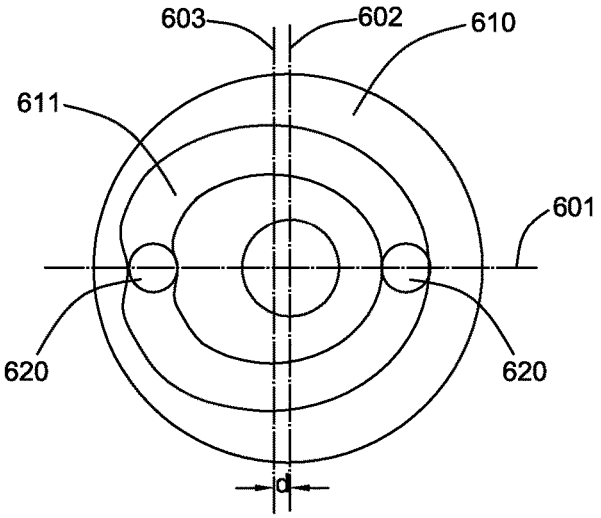
FIG. 8 is a schematic view of the two pins disposed in the groove of the cam shown in FIG. 7 rotated 90 degrees counterclockwise.

Please refer to FIGS. 6-8. In the embodiments in accordance with the FIGS. 6-8, the actuating module 600 comprises two pins 620 coupled between the cam 610 and the sliding base 520, and a relative distance between the two pins 620 is almost constant. FIG. 7 illustrates a schematic view of two pins 620 disposed in a groove 611 of a cam 610 in accordance with an embodiment of the present invention. FIG. 8 illustrates the cam 610 rotated 90 degrees counterclockwise with respect to the cam 610 shown in FIG. 7.

The cam 610 defines a groove 611, and two pins 620 are slidably disposed in the groove 611, i.e., the two pins 620 are capable of sliding along the groove 611. And, in the embodiments in accordance with FIGS. 6-8, the two pins 620 are fixed to the sliding base 520 and the sliding base 520 is constraint and slidable along the slide way 511. Therefore, with the rotation of the cam 610, the two pins 620 slide along the axis 601 in the groove 611. The axis 601 is parallel with the slide way 511 and passes centers of the two pins 620.

Please be noted that the two pins 620 slide along the axis 601 is only an example and should not be understood as a limitation of the scope of the present invention. For example, if the axis passes centers of the two pins 620 does not parallel with the slide way 511, the two pins 620 do not slide along the axis passes the centers of the two pins 620. However, the two pins 620 are also capable of pushing the slide base 520 to move along the slide way 511.

FIGS. 7-8 examples a movement of the two pins 620 with the rotation of the cam 610. With the cam 610 rotated 90 degrees counterclockwise, the two pins 620 move a distance d along the axis 601. The axis 602 is a symmetry axis of the two pins 620 shown in FIG. 7 and the axis 603 is a symmetry axis of the two pins 620 shown in FIG. 8.

Please refer to FIGS. 5-8. The motor 630 drives cam 610 to rotate through the drivetrain 640. With the rotation of the cam 610, two pins 620 move along the axis 601. As the two pins 620 are fixed to the sliding base 520, the movement of the pins 620 drive the sliding base 520 to slide along the sliding way 511.

Figure 9:
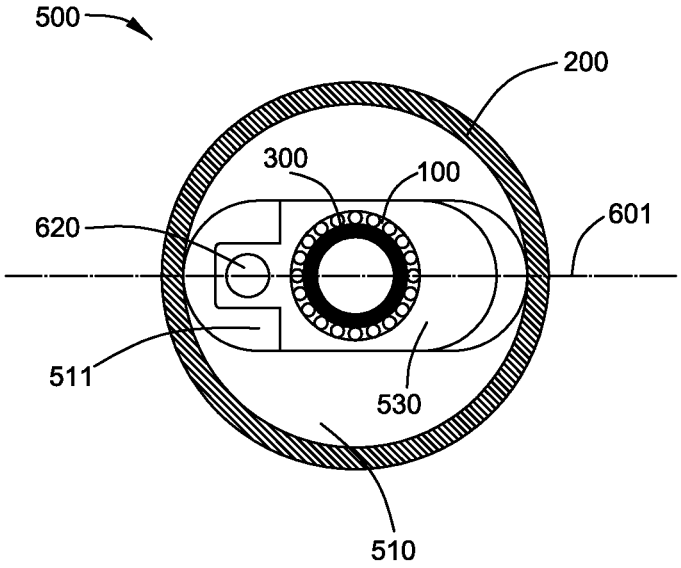
FIG. 9 is a schematic view of a sliding assembly fixed in the drill collar in accordance with another embodiment of the present invention.
Figure 10:
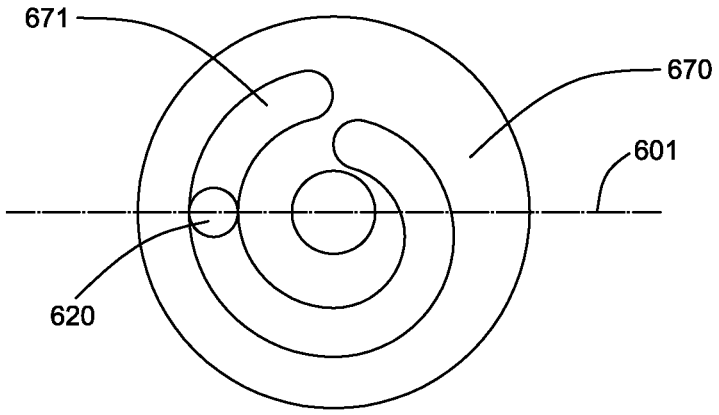
FIG. 10 is a schematic view of a pin disposed in a groove of a cam in accordance with another embodiment of the present invention.

Please refer to FIGS. 9-10. In some embodiments, the cam 610 may be replaced with the cam 670, the sliding base 520 is replaced with a sliding base 530 and there is only one pin 620 coupled between the cam 670 and the sliding base 530. The sliding base 530 slides along the slide way 511. The cam 670 defines a groove 671 and the pin 620 is slidably disposed in the groove 671. Similarly, the motor 630 drives cam 670 to rotate through the drivetrain 640. With the rotation of the cam 670, the pin 620 moves along the axis 601, which is parallel with the sliding way 511 and passes a center of the pin 620. As the pin 620 is fixed to the sliding base 530, the movement of the pin 620 drives the sliding base 530 to slide along the sliding way 511.

Please return to FIGS. 3 & 5. In some embodiments, the auto-adjustable apparatus 90 further comprises a rotation measurement module (not shown) coupled to the drill collar 200, the motor 630, the first gear 641 or the cam 610 for measuring the rotation of the cam 610 or the motor 630.

In some embodiments, the cam 610 or the first gear 641 coupled to the cam 610 is graduated with holes or concaves on the cam 610 or the first gear 641, and the rotation measurement module comprises a proximity sensor (not shown) for detecting the holes or concaves on the cam 610 or the first gear 641. The rotation of the cam 610 or the first gear 641 may be calculated by counting the holes or concaves detected by the proximity sensor. In some embodiments, a controller (not shown) may obtain a detection result from the proximity sensor and count the holes or concaves detected by the proximity sensor. In some embodiments, the controller may be packaged in the drill pipe, and may receive commands from a ground operator (not shown) through a communication system (not shown).

In some embodiments, the cam 610, the first gear 641 coupled to the cam 610 or the motor 630 may comprise a plurality of portions with different magnetization. For example, the cam 610, the first gear 641 or the motor 630 comprises at least a first portion with a first magnetization and a second portion with a second magnetization different from the first magnetization. The rotation measurement module comprises a magnetic induction sensor to detect the first and the second magnetizations. Then, the rotation of the cam 610, the first gear 641 or the motor 630 may be obtained based on the detected first and second magnetizations. The rotation of the first gear 641 is the same as the rotation of the cam 610, and the rotation of the motor 630 may be converted to the rotation of the cam 610 based on a pre-determined rate. In some embodiments, the first magnetization or the second magnetization may be almost zero.

In some embodiments, the controller may obtain a detection result from the magnetic induction sensor to obtain the rotation of the cam 610, the first gear 641 or the motor 630 based on the detected first and second magnetizations.

Please be noted that the rotation measurement module is only an example and should not be understood as a limitation of the scope of the present invention. The rotation measurement module of the present invention may comprise various changes and these changes should all be included in the scope of the present invention.

Figure 11:
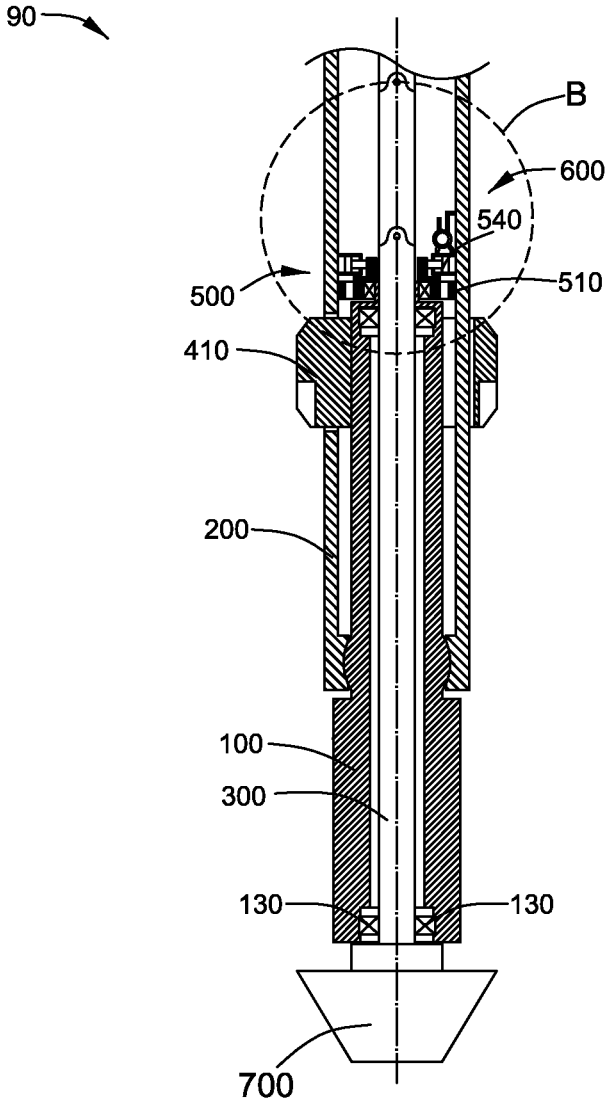
FIG. 11 is a schematic view of an auto-adjustable directional drilling apparatus in accordance with another embodiment of the present invention.
Figure 12:
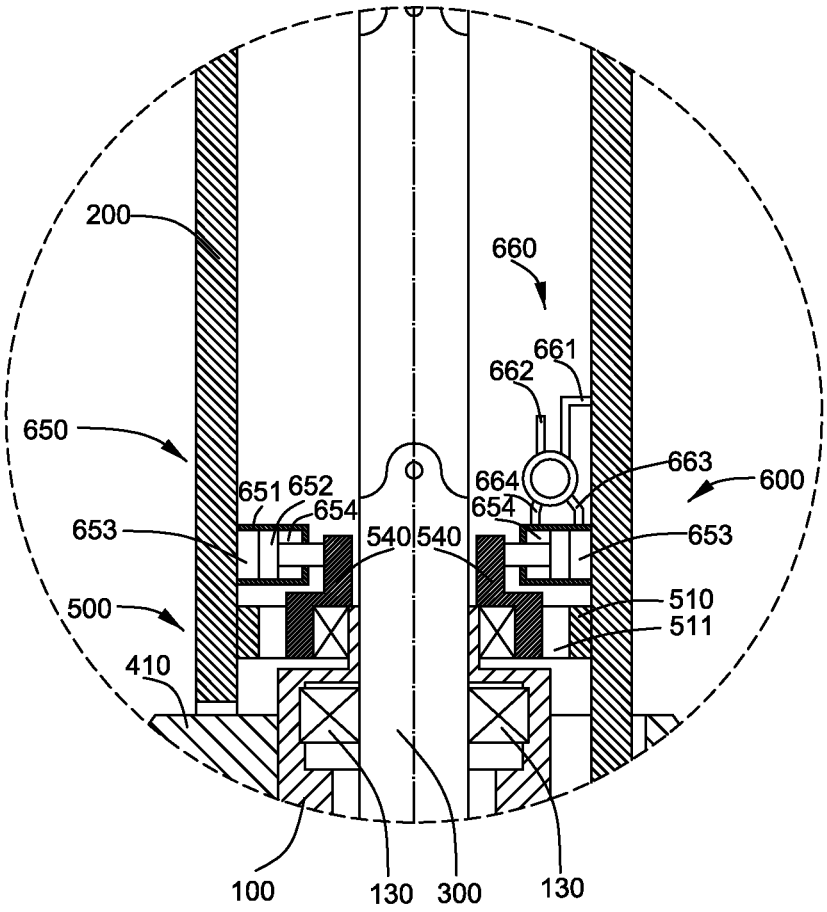
FIG. 12 is an enlarged view of the portion B shown in FIG. 11.

Please refer to FIGS. 11-12. FIG. 11 illustrates a schematic view of an auto-adjustable apparatus 90 for a directional drilling system in accordance with another embodiment of the present invention, and FIG. 12 illustrates an enlarged view of the portion B shown in FIG. 11.

The main difference between the auto-adjustable apparatus 90 in accordance with the FIGS. 3-10 and the auto-adjustable apparatus 90 in accordance with the FIGS. 11-12 comprises that the actuating module 600 of the auto-adjustable apparatus 90 in accordance with the FIGS. 11-12 includes a hydraulic actuating module instead of the cam 610 or 670, the at least one pin 620 and the motor 630. In some embodiments, the sliding base 520 shown in 3 & 5-6 is replaced with a sliding base 540. The sliding base 540 may be similar with the sliding base 520, and the tiny difference between the sliding base 540 and the sliding base 520 may be caused by an adaptation for coupling the sliding base 540 with the hydraulic actuating module.

The hydraulic actuating module is coupled to the sliding base 540 and communicates with the fluid inside the drill collar 200 (hereinafter referred as to "inner fluid") and the fluid outside the drill collar 200 (hereinafter referred as to "outer fluid") to drive the sliding base 540 to slide along the slide way 511. The inner fluid may also be regarded as the fluid inside the drill pipe, and the outer fluid may also be regarded as the fluid outside the drill pipe.

In some embodiments, the hydraulic actuating module comprises two hydraulic actuators 650 and a valve 660.

In some embodiments, each of the two hydraulic actuators 650 comprises a body component 651 coupled to the drill collar 200, and a drive component 652. The drive component 652 is coupled to the sliding base 540 and defines a first cavity 653 and a second cavity 654 together with the body component 651. In some embodiments, the body component 651 is fixed to the drill collar 200. In some embodiments, the drive component 652 comprises a push component for pushing the sliding base 540 to move; in some embodiments, the drive component 652 comprises a piston.

The valve 660 comprises a first port 661 communicating with the outer fluid, a second port 662 communicating with the inner fluid, a third port 663 alternatively communicating the first cavity 653 with the outer or inner fluid and a fourth port 664 alternatively communicating the second cavity 654 with the inner or outer fluid. In some embodiments, the third port 663 communicates the first cavity 653 with the inner fluid while the fourth port 664 communicates the second cavity 654 with the outer fluid, and the third port 663 communicates the first cavity 653 with the outer fluid while the fourth port 664 communicates the second cavity 654 with the inner fluid.

During a downhole drilling operation, the fluid (e.g., the drilling fluid) flows from a mud pool on the surface to the downhole through the drill pipe, and returns from the drill bit to the surface through an annular space formed by the drill pipe and a borehole well for passing the drill pipe through. The fluid flowing from the mud pool to the downhole is the inner fluid and the fluid returning from the drill bit to the surface is the outer fluid. Due to an energy loss in the drilling operation, the pressure of the inner fluid is usually higher than the pressure of the outer fluid. Therefore, utilizing the pressure difference between the inner fluid and the outer fluid, the two drive components 652 of the two hydraulic actuators 650 may be driven to move and the movement of the two drive components 652 drives the sliding base 540 to slide along the slide way 511. In some embodiments, the moving directions of the two drive components 652 are almost the same.

In some embodiments, the controller may be utilized to control the valve 660, i.e., the valve 660 communicates the first cavity 653 with the outer fluid or inner fluid and communicates the second cavity 654 with the inner fluid or outer fluid based on a command from the controller.

Please be noted that, for brevity, only one of the two hydraulic actuators 650 is illustrated with its connection with the valve 660.

Figure 13:
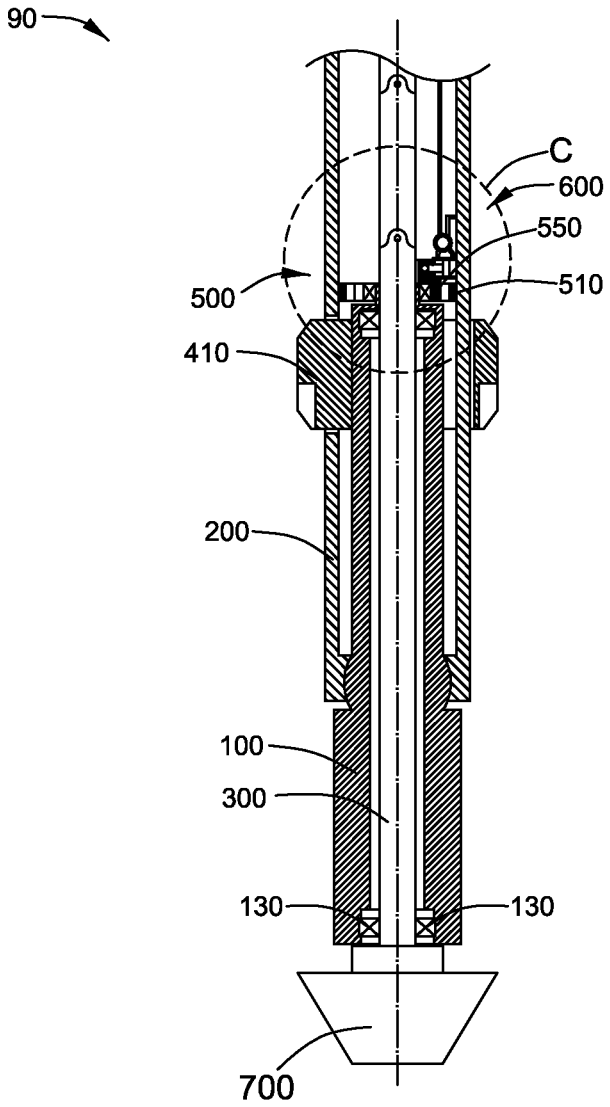
FIG. 13 is a schematic view of an auto-adjustable directional drilling apparatus in accordance with a further embodiment of the present invention.
Figure 14:
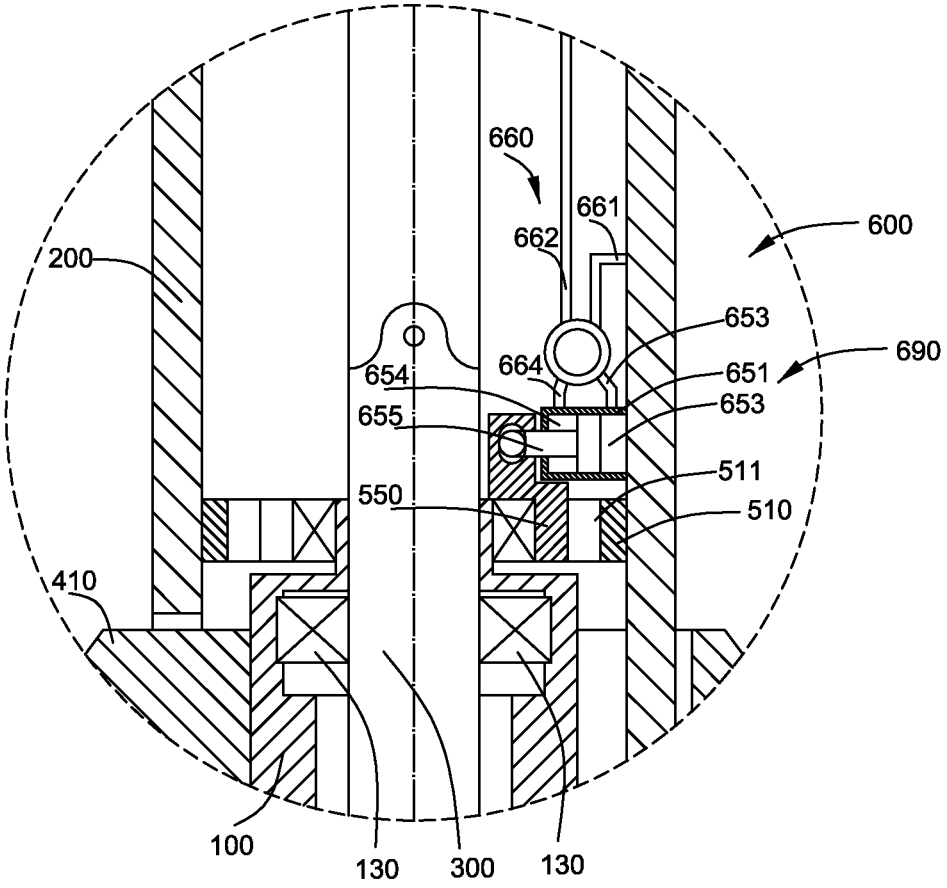
FIG. 14 is an enlarged view of the portion C shown in FIG. 13.

Please refer to FIGS. 13-14. FIG. 13 illustrates a schematic view of an auto-adjustable apparatus 90 for a directional drilling system in accordance with a further embodiment of the present invention, and FIG. 14 illustrates an enlarged view of the portion C shown in FIG. 13.

The main difference between the auto-adjustable apparatus 90 in accordance with the FIGS. 11-12 and the auto-adjustable apparatus 90 in accordance with the FIGS. 13-14 comprises that the hydraulic actuating module of the auto-adjustable apparatus 90 in accordance with the FIGS. 13-14 includes one hydraulic actuator 690 instead of two hydraulic actuators 650. The main difference between the hydraulic actuator 690 and the hydraulic actuator 650 comprises that the hydraulic actuator 690 comprises a drive component 655 instead of a drive component 652.

In some embodiments, the sliding based 540 shown in FIGS. 11-12 is replaced with a sliding base 550. The sliding base 550 may be similar with the sliding base 540, and the tiny difference between the sliding base 550 and the sliding base 540 may be caused by an adaptation for coupling the sliding base 550 with the hydraulic actuator 690. The drive component 655 is coupled to the sliding base 550 and capable of pushing and pulling the sliding based 550 to move along the slide way 511. Similarly, the drive component 655 is driven by the fluids in the first cavity 653 and the second cavity 654 to move.

Please be noted that the hydraulic actuating module in FIGS. 11-14 is only an example and should not be understood as a limitation of the scope of the present invention. The hydraulic actuating module of the present invention may comprise various changes and these changes should all be included in the scope of the present invention. For example, the hydraulic actuating module may comprise two valves 660 connected with the two hydraulic actuators 650 respectively. For another example, the valve 660 may be a single valve or may be formed by a plurality of valves. For a further example, the body component of the hydraulic actuator 650 may comprise a piston and the drive component of the hydraulic actuator 650 may comprise a structure similar to the body component 651 shown in FIG. 12.

Figure 15:
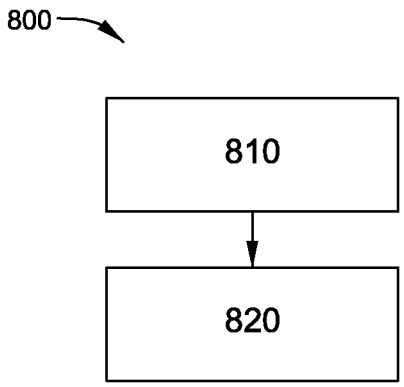
FIG. 15 is a flow diagram of an auto-adjustable directional drilling method in accordance with an embodiment of the present invention.

Please refer to FIGS. 3-15. FIG. 15 illustrates a flow diagram of an auto-adjustable directional drilling method 800 in accordance with an embodiment of the present invention. The auto-adjustable directional drilling method 800 comprises a step 810 and a step 820.

In the step 810, a force is generating via the actuating module 600 coupled to the sliding base 520, 530, 540 or 550. The sliding base 520, 530, 540 or 550 is disposed in the slide way 511 defined by the base support 510 fixed to the drill collar 200. The drill collar 200 is coupled to the drive-shaft housing 100. The active stabilizer 410 is fixed to the drive-shaft housing 100 and movably coupled to the drill collar 200.

In the step 820, the force is utilized to slide the sliding base 520, 530, 540 or 550 along the slide way 511, so as to lead to a relative movement between the active stabilizer 410 and the drill collar 200 and generate a bent angle between the drive-shaft housing 100 and the drill collar 200.

In the embodiments in accordance with FIGS. 3-10, the actuating module 600 comprises a cam 610 or 670 defining a groove 611 or 671, at least one pin 620 slidably disposed in the groove 611 or 671 and fixed to the sliding base 520 or 530, and a motor 630 coupled to the cam 610 or 670 for driving the cam 610 or 670 to rotate. In these embodiments, the step 810 comprises that the motor 630 rotates the cam 610 or 670 to generate the force, and the step 820 comprises that the force is transferred to the sliding base 520 or 530 through the at least one pin 620 to slide the sliding base 520 or 530 along the slide way 511, so as to lead to a relative movement between the active stabilizer 410 and the drill collar 200 and generate a bent angle between the drive-shaft housing 100 and the drill collar 200.

In some embodiments, the actuating module 600 further comprises a drivetrain 640 coupled between the motor 630 and the cam 610 or 670, and the step 810 comprises that the motor 630 rotates the cam 610 or 670 through the drivetrain 640 to generate the force.

In the embodiments in accordance with FIGS. 11-14, the actuating module 600 comprises a hydraulic actuating module coupled to the sliding base 540 or 550 and communicating with the inner fluid or outer fluid. In these embodiments, the step 810 comprises that the hydraulic actuating module communicates with the inner fluid and outer fluid to generate the force, and the step 820 comprises that utilizing the force generated by the hydraulic actuating module to slide the sliding base 540 or 550 along the slide way 511, so as to lead to a relative movement between the active stabilizer 410 and the drill collar 200 and generate a bent angle between the drive-shaft housing 100 and the drill collar 200.

In some embodiments, the hydraulic actuating module comprises at least one hydraulic actuator 650 and a valve 660. Each of the at least one hydraulic actuator 650 comprises a body component 651 coupled to the drill collar 200 and a drive component 652 or 655 coupled to the sliding base 540 or 550. The drive component 652 or 655 defines a first cavity 653 and a second cavity 654 together with the body component 651. The valve 660 comprises a first port 661 communicating with the outer fluid, a second port 662 communicating with the inner fluid, a third port 663 alternatively communicating the first cavity 653 with the outer or inner fluid and a fourth port 664 alternatively communicating the second cavity 654 with the inner or outer fluid. In these embodiments, the step 810 comprises that the valve 660 communicates the first cavity 653 with the outer or inner fluid and communicates the second cavity 654 with the inner or outer fluid to generate the force on the drive component 652 or 655, the step 820 comprises that utilizing the force on the drive component 652 or 655 to move the drive component 652 or 655, so as to drive the sliding base 540 or 550 coupled to the drive component 652 or 655 to slide along the slide way 511, thus lead to a relative movement between the active stabilizer 410 and the drill collar 200 and generate a bent angle between the drive-shaft housing 100 and the drill collar 200.

The embodiments in accordance with the present invention utilize the actuating module 600 to generate a force, and utilize the force to slide a sliding base 520, 530, 540 or 550 along a slide way 511 defined by a base support 510. As the base support 510 is fixed to the drill collar 200, the sliding base 520, 530, 540 or 550 is coupled to the drive-shaft housing 100 and the active stabilizer 410 is fixed to the drive-shaft housing 100 and movably coupled to the drill collar 200, the movement of the sliding base leads to a relative movement between the active stabilizer 410 and the drill collar 200 and generates a bent angle between the drive-shaft housing 100 and the drill collar 200, thus direct the drive shaft 300 to a desired direction. Moreover, in the embodiments that the actuating module 600 comprises a hydraulic actuating module to drive the sliding base 540 or 550 to slide along the slide way 511, the electric power consumption of the auto-adjustable apparatus 90 is low.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. An auto-adjustable directional drilling apparatus, comprising:

a drive-shaft housing;

a drill collar coupled to the drive-shaft housing;

a drive shaft passing through the drive-shaft housing and the drill collar;

an active stabilizer fixed to the drive-shaft housing and movably coupled to the drill collar;

a sliding assembly comprising a base support fixed to the drill collar and a sliding base coupled to the drive-shaft housing, wherein the base support defines a slide way and the sliding base is slidably disposed in the slide way; and an actuating module coupled to the sliding base for driving the sliding base to slide along the slide way, wherein the actuating module shifts the sliding base along the slide way to radially outwardly shift the active stabilizer relative to the drill collar.

2. The apparatus of claim 1, wherein the actuating module comprises:

a cam defining a groove;

at least one pin slidably disposed in the groove and fixed to the sliding base; and a motor coupled to the cam for driving the cam to rotate.

3. The apparatus of claim 2, further comprising a rotation measurement module for measuring the rotation of the cam or the motor.

4. The apparatus of claim 2, wherein the at least one pin comprises two pins.

5. The apparatus of claim 2, wherein the actuating module further comprises a drivetrain coupled between the motor and the cam.

6. The apparatus of claim 5, wherein the drivetrain comprises:

a first gear rotatably coupled to the drill collar and fixed to the cam; and a second gear coupled between the motor and the first gear.

7. The apparatus of claim 1, wherein the actuating module comprises a hydraulic actuating module coupled to the sliding base and communicating with fluid inside the drill collar and fluid outside the drill collar to drive the sliding base to slide along the slide way.

8. The apparatus of claim 7, wherein the hydraulic actuating module comprises:

a hydraulic actuator comprising a body component coupled to the drill collar, and a drive component coupled to the sliding base and defining a first cavity and a second cavity together with the body component; and a valve comprising a first port communicating with the fluid outside the drill collar, a second port communicating with the fluid inside the drill collar, a third port alternatively communicating the first cavity with the fluid inside or outside the drill collar and a fourth port alternatively communicating the second cavity with the fluid inside or outside the drill collar.

9. The apparatus of claim 8, wherein the body component is fixed with respect to the drill collar, and the drive component comprises a piston.

10. The apparatus of claim 1, wherein the drive shaft is coupled to a mud motor.

11. The apparatus of claim 1, wherein the drive-shaft housing is coupled to the drill collar through a ball joint and a connection pin, the connection pin being located on the ball joint and connected with the drive-shaft housing and the drill collar.

12. The apparatus of claim 1, wherein the drive shaft is coupled to the drive-shaft housing through a bearing assembly.

13. An auto-adjustable directional drilling method, comprising:

generating a force via an actuating module coupled to a sliding base disposed in a slide way defined by a base support fixed to a drill collar coupled to a drive-shaft housing, an active stabilizer being fixed to the drive-shaft housing and movably coupled to the drill collar; and utilizing the force to slide the sliding base along the slide way so as to lead to a relative movement between the active stabilizer and the drill collar and generate a bent angle between the drive-shaft housing and the drill collar.

* * * * *